US006000879A

United States Patent [19]

Greppmair

[11] Patent Number: 6,000,879

[45] Date of Patent: Dec. 14, 1999

[54] GASOLINE-POWERED TAMPER

[75] Inventor: Martin Greppmair, München, Germany

[73] Assignee: Wacker-Werke GmbH & Co. KG, Munich, Germany

[21] Appl. No.: 09/048,799

[22] Filed: Mar. 26, 1998

Related U.S. Application Data

[63] Continuation-in-part of application No. 08/918,237, Aug. 25, 1997, abandoned.

[30] Foreign Application Priority Data

Apr. 15, 1997 [DE] Germany ..... 297 06 775 U

[51] Int. Cl.[6] ..... E01C 19/32

[52] U.S. Cl. ..... 404/133.1; 404/133.05

[58] Field of Search ..... 404/133.05, 133.1, 404/113, 133, 133.2; 123/41.66, 41.7, 195; 74/571; 181/198; 173/211

[56] References Cited

U.S. PATENT DOCUMENTS

| | | | |
|---|---|---|---|
| 2,677,355 | 5/1954 | Maurer et al. | 404/133.1 |
| 3,880,134 | 4/1975 | Thien et al. | 123/195 |
| 3,929,207 | 12/1975 | Urban | 181/198 |
| 3,963,094 | 6/1976 | Nowikas | 181/198 |
| 4,014,620 | 3/1977 | Vural et al. | 404/133 |
| 4,170,427 | 10/1979 | Grane | 404/133 |
| 4,342,289 | 8/1982 | Komp | 123/41.7 |
| 4,442,731 | 4/1984 | Burger | 74/571 |
| 4,459,944 | 7/1984 | Kirchweger et al. | 123/41.66 |
| 5,573,075 | 11/1996 | Henry et al. | 173/211 |

*Primary Examiner*—Thomas B. Will
*Assistant Examiner*—Raymond Addie
*Attorney, Agent, or Firm*—Herbert Dubno; Andrew Wilford

[57] ABSTRACT

A tamper has a housing, a transmission in the housing converting rotary movement to reciprocating movement, and a tamper plate underneath the transmission and connected thereto for tamping material over which the tamper is moved. A gasoline-fueled engine mounted on the housing supplies rotary movement to the transmission and a fuel tank mounted on the housing adjacent the engine is connected with the engine for supplying fuel thereto. A dome-shaped and downwardly concave cover fixed to the handle is positioned above the engine. The cover is made of a sound-absorbing material and includes a rigid shell having an underside provided with a layer of sound-absorbing material.

7 Claims, 3 Drawing Sheets

GASOLINE-POWERED TAMPER

CROSS REFERENCE TO RELATED APPLICATION

This application is a continuation-in-part of application Ser. No. 08/918,237 filed Aug. 25, 1997 (now abandoned).

FIELD OF THE INVENTION

The present invention relates to a gasoline-powered tamper. More particularly this invention concerns a cover for such a tamper.

BACKGROUND OF THE INVENTION

A gasoline-powered tamper for compacting earth comprises as described in my above-cited copending US patent application a substantially rectangular frame and a transmission mounted on the frame between ends thereof and extending downward from the frame. The transmission converts rotary movement to reciprocating movement and includes a transmission casing. A tamper leg connected to the transmission and having a tubular leg casing extends downward therefrom and is vertically reciprocatable by the transmission. A tamper plate or foot affixed to the leg at a bottom thereof tamps material over which the tamper is moved. A gasoline-fueled engine connected with the transmission casing supplies the rotary movement to the transmission. A fuel tank spanning opposite long limbs of the frame is connected with the engine for supplying fuel thereto.

Such an apparatus produces a great deal of noise, mainly caused by the engine exhaust and air intake as well as from the transmission that converts the rotary engine output to linear tamper foot movement. The engine is normally mounted right on the transmission so that its noise is reflected back and seemingly amplified. The tamper leg is invariably mounted with some play that is taken up with each linear movement, causing further noise to be generated and the bouncing of the foot on the ground generates further unacceptable noise.

As a result the user of such a machine is normally required to wear a hearing protector, although this type of rule is relatively difficult to enforce in the field. In general, such machines are particularly noisy and subject the operator, who must stand right over them, to the worst of the noise.

OBJECTS OF THE INVENTION

It is therefore an object of the present invention to provide an improved gasoline-powered tamper.

Another object is the provision of such an improved gasoline-powered tamper which overcomes the above-given disadvantages, that is which subjects its operator to substantially reduced noise.

SUMMARY OF THE INVENTION

A tamper has according to the invention a housing, a transmission in the housing converting rotary movement to reciprocating movement, and a tamper plate underneath the transmission and connected thereto for tamping material over which the tamper is moved. A gasoline-fueled engine mounted on the housing supplies rotary movement to the transmission and a fuel tank mounted on the housing adjacent the engine is connected with the engine for supplying fuel thereto. A dome-shaped and downwardly concave cover fixed to the housing is positioned above the engine.

While the cover is basically flat, its downwardly concave shape and overall size allow it to intercept noise emanating from the tamper and deflect it back or absorb it. The downwardly concave and upwardly convex shape also stiffens the cover so that, even though it is vibrated greatly as the tamper works, it retains its shape and function.

According to the invention the cover is made of a sound-absorbing material. It can include a rigid shell having an underside provided with a layer of sound-absorbing material. Thus the shell imparts physical strength to the cover while the softer mineral wool or heat-resistant plastic foam lining its underside absorbs and dissipates sound.

The upper surface of the cover in accordance with the invention is upwardly convex. In addition the cover is formed with stiffening ribs. Thus the possibility of sound actually making the cover vibrate and transmit this sound is largely eliminated.

The cover is provided with indicia regarding operation of the tamper. Instructions about starting and servicing the tamper, for instance, can be permanently printed on the cover.

According to the invention the cover extends at least partially over the housing. It can extend over the engine and housing and even over the fuel tank. In general it extends over substantially all of an upper side of the tamper. Thus the cover not only protects the user from sound coming up from the tamper, but also protects the tamper from anything coming down on it, shedding dust and dirt as well as rain, for instance. The fuel tank is afforded a necessary level of protection by the cover.

The dome-shaped cover is formed with throughgoing holes adapted to pass operating elements of the tamper. These holes can accommodate the throttle lever for the motor as well as the filler spout for the fuel tank.

The tamper in accordance with the invention further has a handle fixed to the housing and carrying the cover. The cover can also be fixed to the housing. Plastic or rubber vibration-insulating mounts secure the cover on the tamper.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
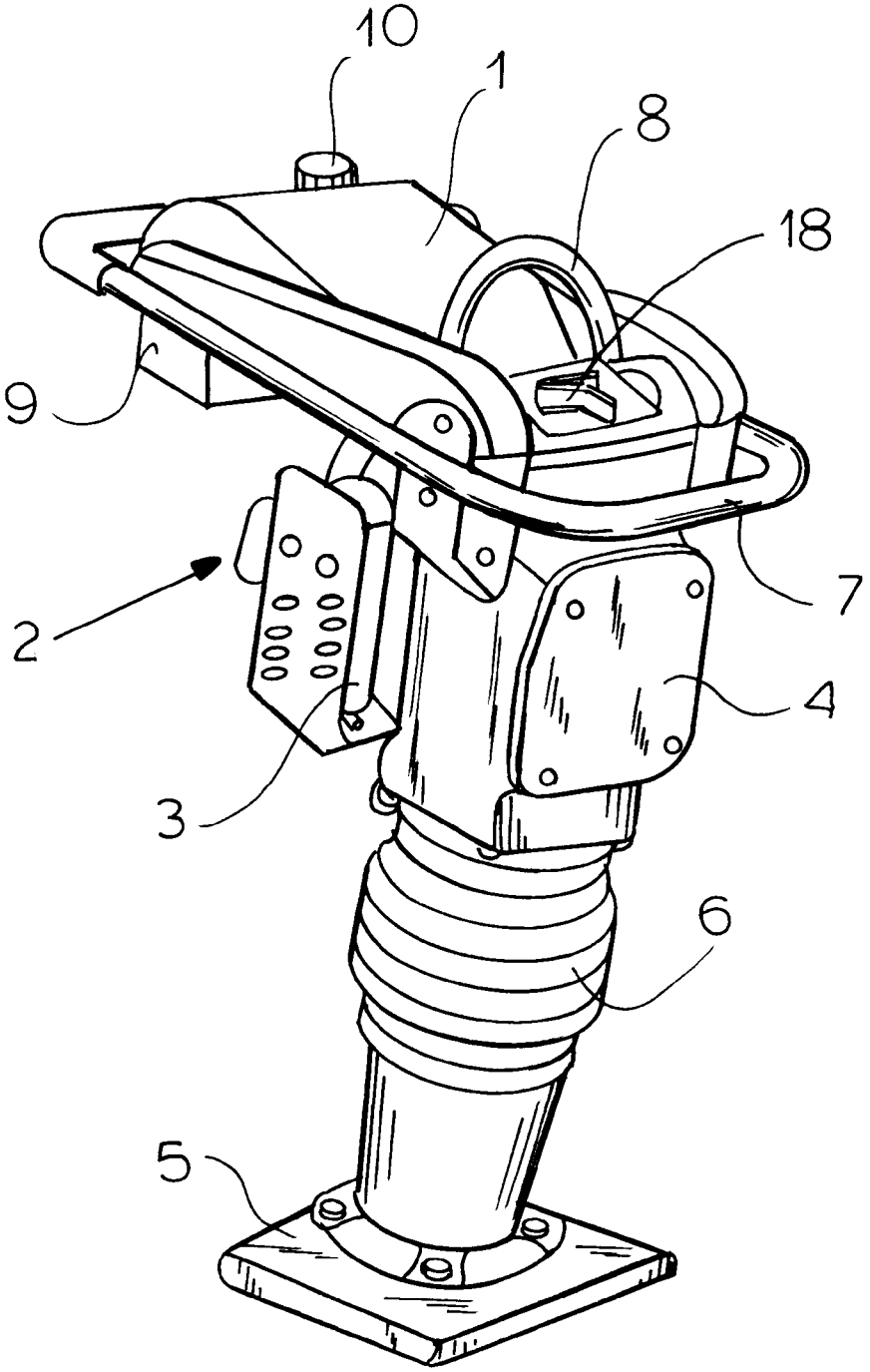
FIG. 1 is a small-scale perspective view of the tamper according to the invention.
Figure 2:
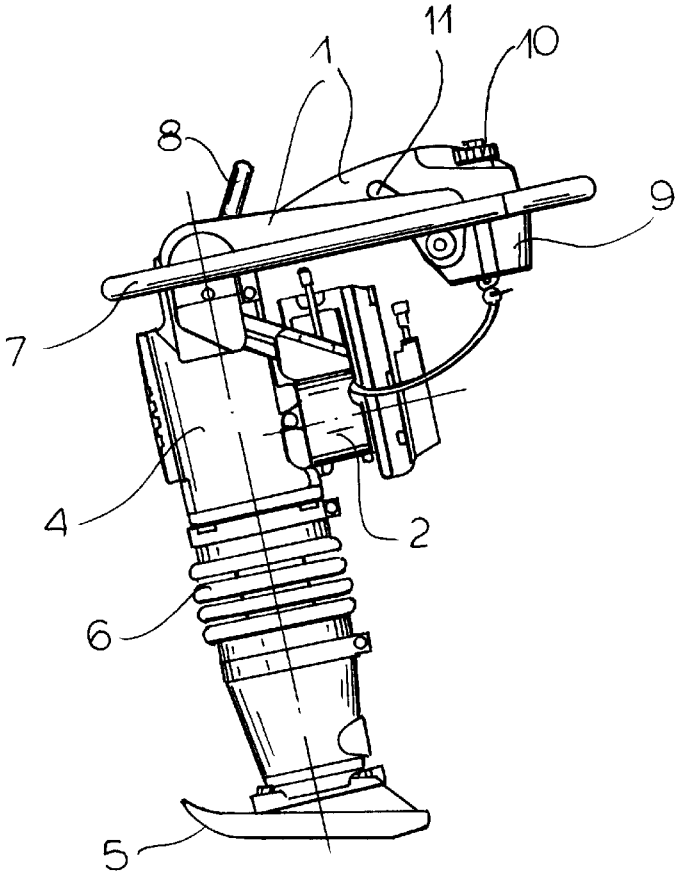
FIG. 2 is a side view of the tamper of FIG. 1.
Figure 4:
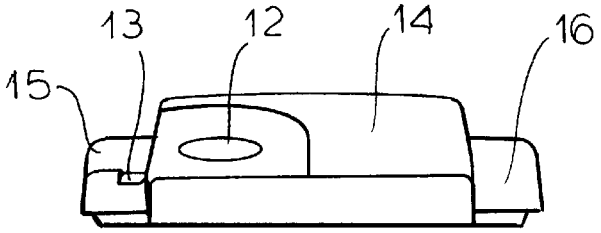
FIG. 4 is a an end view taken in the direction of arrow IV of FIG. 3.
Figure 6:
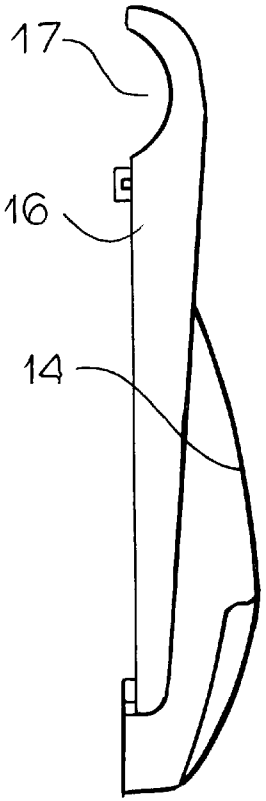
FIG. 6 is a side view taken in the direction of arrow VI of FIG. 3.
Figure 5:
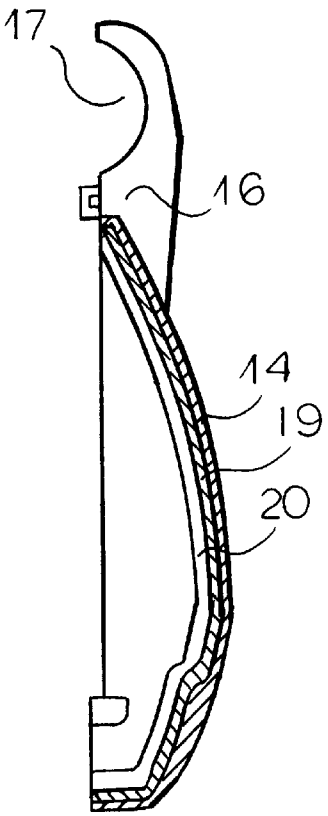
FIG. 5 is a section taken along line V—V of FIG. 3.
Figure 3:
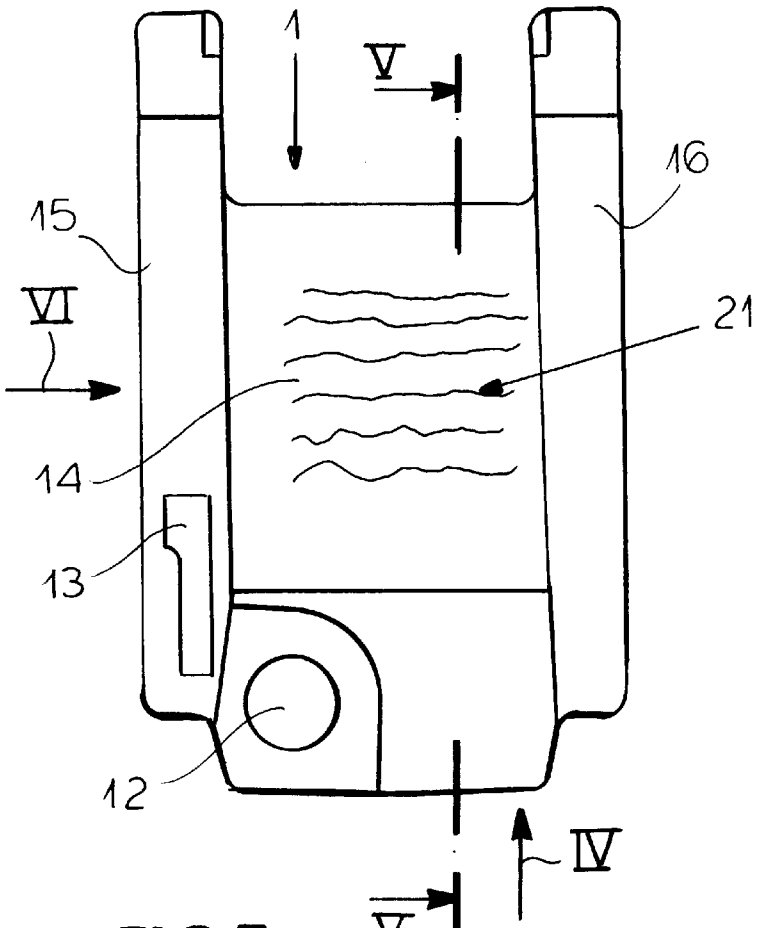
FIG. 3 is a top view of the cover of the tamper.

As seen in FIGS. 1 and 2 a tamper as described generally in my above-cited copending application has a gasoline engine 2 mainly underneath a downwardly concave dome-shaped cover 1 and having an exhaust or muffler 3. A housing 4 carries this engine 2 and contains a transmission that converts the engine's rotary output into generally vertical linear movement of a tamping plate or foot 5, with an accordion-type cuff or bellows 6 connected between the housing 4 and the foot 5.

An annular or bow-type handle 7 formed of round-section tubing is fixed at the upper end of the housing 4 and a loop

8 is provided for grappling the device about on the job site as it is normally too heavy to move readily by hand. The handle 7 extends around a gas tank 9 having a fill spout 10 and a gas lever 11 controlling the speed of the engine 9 is mounted on this handle 7.

The cover 1 extends over the engine 2, muffler 3, and gas tank 9. It is made as shown in FIGS. 3 through 6 of a durable synthetic resin having on its concave underside a liner 19 of softer sound-absorbing foam or mineral wool and as mentioned is generally dome-shaped or downwardly concave so as to intercept all noise coming up from the tamper. Furthermore it has a domed center part 14 whose broad upper surface is suitable for carrying indicia 21, for instance instructions on operating the tamper, and has a pair of ridged U-section side parts 15 and 16 that fit against the parallel side bars of handle 7 and that stiffen it. A hole 12 cut into its rear end accommodates the gas-tank spout 10 and another hole 13 passes the throttle lever 11. Cutouts 17 at its front fit complementarily with the housing 4 while leaving its center exposed so that a nut 18 can be released for access to this housing 4 and to an air cleaner for the engine's intake. Ribs 20 may be formed on its inside or outside face to stiffen and strengthen it. Unillustrated shock-absorbing fasteners secure the cover 1 to the handle 7.

I claim:

1. A tamper comprising:

a housing;

a transmission in the housing converting rotary movement to reciprocating movement;

a tamper plate underneath the transmission and connected thereto for tamping material over which the tamper is moved;

a gasoline-fueled engine mounted on the housing and supplying rotary movement to the transmission;

a fuel tank mounted on the housing adjacent the engine and connected with the engine for supplying fuel thereto; and a dome-shaped and downwardly concave cover extending over the fuel tank, formed with at least one through-going hole adapted to pass an operating element of the tamper, fixed to the handle, positioned above the engines and including a rigid shell having an underside provided with a layer of sound-absorbing material.

2. The tamper defined in claim 1 wherein the cover is formed with stiffening ribs.

3. The tamper defined in claim 1 wherein the cover is provided with indicia regarding operation of the tamper.

4. The tamper defined in claim 1 wherein the cover extends at least partially over the housing.

5. The tamper defined in claim 1 wherein the cover extends over the engine and housing.

6. The tamper defined in claim 1 wherein the cover extends over substantially all of an upper side of the tamper.

7. The tamper defined in claim 1, further comprising vibration-insulating mounts securing the cover on the tamper.

* * * * *